United States Patent [19]

Bedard et al.

[11] 4,388,566

[45] Jun. 14, 1983

[54] PASSIVE CONTROL NETWORK FOR REMOTE CONTROL OF LOAD OUTPUT LEVEL

[75] Inventors: James F. Bedard; Charles W. Eichelberger, both of Schenectady, N.Y.; De-Yu Chen, Blacksburg, Va.

[73] Assignee: General Electric Company, New York, N.Y.

[21] Appl. No.: 235,191

[22] Filed: Feb. 17, 1981

[51] Int. Cl.[3] ..... G05F 1/00

[52] U.S. Cl. ..... 315/291; 315/224; 315/276; 315/DIG. 4; 323/301; 323/353; 331/177 R

[58] Field of Search ..... 315/209 R, 219, 224, 315/276, 291, DIG. 4; 331/177 R; 323/233, 299, 301, 351, 353, 364, 905

[56] References Cited

U.S. PATENT DOCUMENTS 3,249,892 5/1966 Van Geen ..... 331/177 R X
3,419,753 12/1968 Schultz et al. ..... 315/224 X
3,619,713 11/1971 Biega et al. ..... 315/224 X
4,057,751 11/1977 Bonsignore et al. ..... 315/DIG. 4

FOREIGN PATENT DOCUMENTS 2416619 10/1979 France ..... 315/224

*Primary Examiner*—Eugene R. LaRoche
*Attorney, Agent, or Firm*—Walter C. Bernkopf

[57] ABSTRACT

A passive control network for connection between a pair of load output level setting terminals, as on a ballast for a dimmable fluorescent lamp in a lighting system, to provide a required variable impedance, where the magnitude of the impedance establishes the load output level. The passive control network includes an isolation transformer for coupling a periodic waveform at the load input terminals to the variable impedance component, the magnitude of which impedance is reflected through the transformer to provide the load level-setting impedance.

13 Claims, 1 Drawing Figure

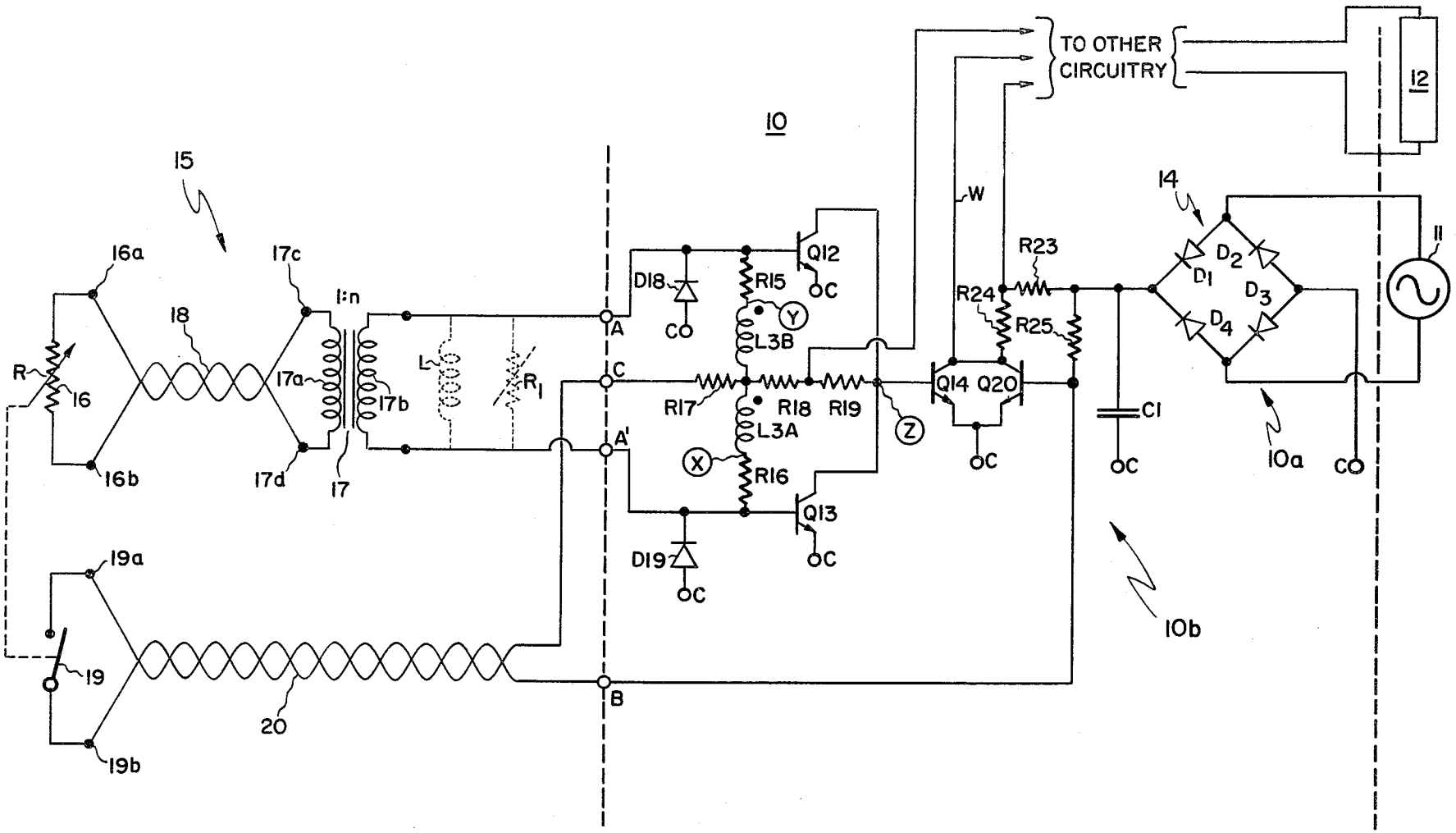
12
11
CO
10a
D1
D2
D3
D4
14
C1
OC
10b
TO OTHER CIRCUITRY
R23
R24
R25
Q14
Q20
W
Z
R19
R18
R17
Q12
Q13
R15
R16
L3B
L3A
Y
X
D18
D19
10
A
C
A'
B
R1
L
17b
1:n
17
17a
17c
17d
20
15
18
16a
16b
16
R
19a
19b
19

PASSIVE CONTROL NETWORK FOR REMOTE CONTROL OF LOAD OUTPUT LEVEL

BACKGROUND OF THE INVENTION

The present invention is directed to an electrical load output level control network and, more particularly, to a novel passive network for controlling the output level of a load, such as a ballast-lamp lighting load combination.

The ability to control the output level of a load, particularly from a remote location, facilitates many economic advantages in this day and age of energy conservation. With the advent of variable load-output-level controls, such as are found in the variable-output gas-discharge lamp/ballast system of co-pending U.S. patent application Ser. No. 117,942, filed on Aug. 14, 1980, assigned to the assignee of the present application and incorporated herein by reference, control of fluorescent lamp light output is now practical. However, greatest acceptance of variable output level control systems, particularly those of the type requiring the use of a variable impedance connected to the load controller input for establishing the load output level, require that an efficient, low-cost and highly reliable variable impedance network be provided. It is also highly desirable that the control network be entirely passive and provide isolation between the user (adjusting the control network) and the potentially hazardous voltages and current utilized in the load device.

BRIEF DESCRIPTION OF THE INVENTION

In accordance with the invention, a passive control network for connection to the input terminals of a load having an output level determined by the magnitude of the impedance connected between the input terminals, includes a variable impedance element and means for electrical isolating the variable impedance element from the load-level-controlling-input terminals.

Advantageously, the variable impedance element provides a variable electrical resistance and the isolation means is an electrical transformer having its primary winding connected between the pair of input terminals and a secondary winding connected across the variable resistance element, thus providing isolation therebetween. In one preferred embodiment, the isolation transformer has a greater number of turns in the primary winding then in the secondary winding, whereby the impedance of the variable resistance element is increased at the load input terminals, while the magnitude of a periodic waveform at the input terminals is provided with reduced magnitude across the human-contactable variable resistance.

Accordingly, it is an object of the present invention to provide a novel passive control network for remote control of load output level.

This and other objects of the invention will become apparent upon consideration of the following detailed description, when read in conjunction with the drawing.

BRIEF DESCRIPTION OF THE DRAWINGS

The sole FIGURE is a schematic diagram of a portion of a ballast utilized for providing an adjustable light output level from a fluorescent lamp, and of one presently preferred passive network for controlling lamp (load) output level.

DETAILED DESCRIPTION OF THE INVENTION

Referring to the sole FIGURE, a ballast 10 is connected between an electrical energy source 11 and one or more gas-discharge lamps, such as a fluorescent lamp 12. Ballast 10, of which only the power supply section **10*a* and control section 10*b* are shown, is configured to control the luminous output of fluorescent lamp 12** as a function of an externally-provided electrical impedance, connected between control terminals A and A′ for shunting of control current from a pair of control transistors Q12 and Q13. The on-off function of the ballast-lamp combination is controlled by the magnitude of an impedance connected between an on-off terminal B and a ballast common line, at terminal C.

One method for providing a variable (dimmable) fluorescent lamp light level is described and claimed in co-pending application, Ser. No. 117,835 and one embodiment of an inverter-type ballast utilizing that method for fluorescent lamp light level control is described and claimed in co-pending application Ser. No. 117,942 both of which applications were filed Aug. 14, 1980 assigned to the assignee of the present invention, and incorporated herein by reference in their entirety. As described in the aforementioned patent applications, the AC energy source 11 is coupled to a bridge rectifier 14, comprised of diodes $D_1$–$D_4$, and a filter capacitor Cl, which forms a power supply section **10*a* providing DC potential to the ballast. The ballast includes a di/dt control circuit section 10*b* and a ballast high-power inverter section (not shown) which is controlled by section 10*b* to provide relatively high-frequency energizing waveforms to fluorescent lamp 12. The level of light produced by fluorescent lamp 12 is a function of the frequency of the high-power inverter, which frequency is controlled by circuit section 10*b*. The control section 10*b*** includes a di/dt sensor, or detector, consisting of transistors Q12 and Q13; resistors R15, R16, R17, R18 and R19; and dual transformer windings L3A and L3B. The di/dt-sensing control circuit has a threshold, or trip point, which is the point at which the voltages at points X and Y drop to a low enough voltage to turn off both of transistors Q12 and Q13. Accordingly, the pair of transformer windings are wound upon a portion of the inverter transformer (not shown), such that if the voltage across transformer winding L3A is negative at the dotted end, a current will flow from point X, through resistor R16, and turn on transistor Q13, while the voltage across winding L3B is simultaneously negative at the dotted end, whereby transistor Q12 is turned off. Similarly, when the voltage across winding L3B is positive at the dotted end, a current will flow from point Y, through resistance R15, and turn on transistor Q12, while the voltage across winding L3A is positive at the dotted end and applies a negative voltage to the base electrode of transistor Q13, which transistor is cutoff. As the windings L3A and L3B are of a substantially equal number of turns, it will be appreciated that the voltages at points X and Y (obtained by coupling both windings to the same transformer core with substantially equal coupling coefficients) are substantially equal in magnitude but of opposite polarity, as indicated by the phasing dots. Thus, when the voltage at point X drops below a predetermined threshold value, transistor Q13, which was previously conducting, will turn off. At the same time the voltage at point Y is equal in magnitude, but of opposite polarity, such that transistor Q12 is not conducting, whereby a node Z is at a voltage above common line C potential, since neither transistor Q12 nor transistor Q13 are conducting. As node Z is not at common line C potential, transistor Q14 is caused to conduct. This initiates a reversal of inverter load voltage, as described in more detail in the aforementioned patent applications. This load voltage reversal reverses the polarity of the voltages across windings L3A and L3B, whereby transistor Q12 is caused to conduct and turn off transistor Q14. The point X voltage changes until, at the preset threshold value, transistor Q12 turns off and again raises the voltage at node Z. Transistor Q14 is thus turned on, to initiate reversal of the load voltage. The above-summarized action continues in cyclic fashion, with transistors Q12 and Q13 being alternately turned off when the absolute amplitude of the voltage at one of points X and Y reaches a preset threshold value. This preset threshold value is established by the turns ratio of windings L3A and L3B. Resistances R15 and R16, of substantially equal magnitude, are utilized to convert the voltages at point X and Y to currents for driving a base electrode of respective transistors Q12 and Q13. The threshold value, at which the load voltage is switched, and therefore establishing the light output of load 12, may be changed by the connection of an impedance between (a) each of the base electrodes of transistors Q12 and Q13, and (b) either common line C potential or the opposite transistor base electrode. This causes the shunting of control current from the base electrode of the pair of control transistors Q12 and Q13. Thus, connection of a resistance $R_1$ between input terminals A and A' causes the instantaneous positive potential at one of terminals A or A' to be reduced, upon application of the associated winding voltage to the associated base electrode of respective transistors Q12 or Q13, via the voltage divider provided by resistances R15 and R16 and the equivalent resistance $R_1$ between terminals A and A'. The voltage divider action is further enhanced by the connection of an opposite end of resistance $R_1$ back to the instantaneous negative voltage at the remaining one of terminals A and A' respectively. By means of the voltage divider action, the voltage, across that one of windings L3A and L3B associated with the transistors to be turned off, is applied to the base electrode with reduced magnitude for a decreasing magnitude of $R_1$, whereby a particular polarity of voltage is applied to the load for increasingly shorter time intervals before load voltage switching occurs, thus increasing the load driving frequency and lowering the light output of fluorescent lamp 12. If the resistance $R_1$ between terminals A and A' is substantially zero (a short-circuit), the voltages at the base electrodes of both transistors Q12 and Q13, will be substantially zero with respect to their emitter electrodes since the voltages at point X and Y are always of substantially the same magnitude but of opposite polarity, and as resistance R15 and R16 are of substantially equal value. In this condition, transistors Q12 and Q13 are always cutoff and a maximum frequency (minimum output level) condition occurs. Conversely, if the resistance $R_1$ between input terminals A and A' is of a relatively high value, the transistor base electrodes will then be essentially isolated from one another and the respective transistors Q12 and Q13 will be alternately turned on with relatively low absolute voltage magnitudes across the associated one of windings L3A and L3B; this corresponds to a relatively low frequency of inverter operation, whereby fluorescent light load 12 operates at a substantially constant maximum power and produces a substantially constant maximum light output, as further described and claimed in U.S. Pat. No. 4,060,752 (wherein the base electrodes of the control transistors are in no way coupled to each other) which patent is assigned to the assignee of the present invention and incorporated herein in its entirety by reference hereto.

In accordance with the present invention, the load-level-determining resistance $R_1$ between input terminals A and A' is provided by connection of a variable resistance element 16, of resistance magnitude R, across the secondary winding 17*a* of a transformer 17, having its primary winding 17*b* connected to input terminals A and A'. Transformer 17 has a secondary winding-to-primary winding turns ratio of 1:n. Typically, the voltage between input terminals A and A' is a square wave of frequency typically varying from approximately 20 KHz to about 70 KHz, and inversely increasing in frequency as a function of the load lamp output level. With transformer winding 17*b* connected between input terminals A and A', the level-setting circuit 15 is a self-powered circuit whereby a square wave appears across variable resistance 16 with a magnitude $V/(n^2)$ (where V is the voltage of the waveform appearing between input terminals A and A'), and with the same frequency as the square wave across the primary winding. The magnitude of control resistance $R_1$ is, due to the impedance step-up action of transformer 15, equal to the magnitude of the actual resistance R times the square of the turns ratio n, or $R_1=R(n^2)$. Transformer 17 is designed to not only have the desired secondary winding-to-primary winding turns ratio n, but also to have a magnetizing inductance L which provides an impedance (equal to $2\pi FL$, where F is the instantaneous frequency of operation of the ballast control circuit 10) which is very much greater than the magnitude of control resistance $R_1$. Typically, the magnetizing inductance impedance at the lowest frequency of operation will be at least an order of magnitude greater than the maximum control resistance $R_1$ magnitude. Utilizing this criteria for selection of variable resistance 16 and transformer 17, lamp 12 output variations over at least a 20:1 range have been achieved.

Advantageously, transformer 17 is located adjacent to ballast 10, while level-setting variable resistance 16 may be located adjacent to, or remote from, the transformer and ballast-lamp combination. Accordingly, a relatively low resistance coupling medium 18, such as a twisted wire pair of coaxial cable, is utilized to connect the pair of variable resistance terminals 16*a* and 16*b* to the transformer secondary winding terminals 17*c* and 17*d*. The only limitation upon medium 18 is that the total electrical resistance thereof be several orders of magnitude less than the minimum resistance of variable resistance 16, and that excessive hum, noise and other extraneous signal pickup be prevented from occuring between resistance 16 and transformer terminal 17*c* and 17*d*.

As previously described, the inverter portion of the ballast switches the voltage across load 12 responsive to transistor Q14 entering the cutoff condition. By paralleling transistor Q14 with another transistor Q20, inverter switching (and therefore the existence of the periodic waveform necessary to cause load power consumption) may be defeated if parallel transistor Q20 remains in the saturated condition, preventing the voltage at line W (the common collector connection between transistor Q14 and Q20) from rising. Thus, if the magnitude of resistance R25 is chosen such that transistor Q20 normally receives sufficient base electrode current to remain in the saturated condition, load 12 is turned off. If a ballast input terminal B, connected to the base electrode of transistor Q20, is connected to system common line C, the base electrode current of transistor Q20 is shunted to common and transistor Q20 is cutoff, allowing the load to be turned on and the output (light) level thereof to be controlled by the magnitude of the impedance (resistance $R_1$) provided between input terminals A and A' by action of the transformer 17 on the impedance-magnitude (resistance magnitude R) of variable element 16. Conversely, if input terminal B is disconnected from ballast common terminal C (i.e. input terminal B is allowed to float), transistor Q20 receives enough base electrode drive current to reenter saturation and turn off load 12.

In accordance with another aspect of the invention, a switch means 19, such as a single-pole, single-throw switch and the like, may, but need not, be mechanically coupled to the impedance-setting shaft of the variable impedance, e.g. a rheostat, utilized for element 16, with switch terminals 19*a* and 19*b* connected by a suitable medium 20, such as another twisted wire pair and the like, between on/off input terminal B and common line terminal C of the ballast, for providing on-off control thereof. Similar resistance-magnitude and extraneous-signal-pickup criteria, as applied to medium 18, are applicable to medium 20. It should be understood that media 18 and 20 may be combined into a four-wire set connecting a switch-rheostat combination of elements 16 and 19, at a remote location, with a transformer 17 and ballast 10-lamp 12 combination at another location, whereby remote control of the (light) output of the load (lamp 12) is facilitated. Of course, variable resistance 16 and/or switch 19 may be located immediately adjacent to transformer 17 and the ballast 10-load 12 combination, whereby the length of media 18 and/or 20 will be minimal, if present at all. Similarly, one of variable resistance 16 and switch 19 may be located at a location remote from the location of the other and/or remote from the location of the ballast 10-load 12 combination, as required for a particular desired use.

There has just been described a novel passive load level control which may be located adjacent to, or remote from, the load having the output level thereof controlled.

While one preferred embodiment of our novel passive load level control circuit has been described in detail herein, many modifications and variations will now occur to those skilled in the art. It is our intention, therefore, to be limited only by the scope of the appending claims and not by the specific details described for the preferred embodiment herein.

What is claimed is:

1. Power load control apparatus comprising:

(a) a load circuit adapted to supply an alternating current of variable frequency to an electrical load;

(b) said load circuit comprising input terminals and means for providing a periodic waveform across said input termimals;

(c) a transformer comprising a primary winding and a secondary winding;

(d) said primary winding being connected in circuit with said input terminals;

(e) a variable impedance element;

(f) a passive circuit comprising said variable impedance element in circuit with said secondary winding and energized by the periodic waveform coupled by the transformer from said input terminals;

(g) said load circuit being adapted to vary the frequency of the alternating current adapted to be supplied to a load as a function of the magnitude of the impedance reflected by the variable impedance element to the input terminals whereby adjustment of the impedance magnitude of the variable impedance element controls the frequency of the alternating current adapted to be supplied by the load circuit to an electrical load.

2. The apparatus of claim 1, wherein the variable impedance element is a variable electrical resistance.

3. The apparatus of claims 1 or 2, wherein said transformer has a voltage step-down ratio greater than one between said primary winding and said secondary winding.

4. The apparatus of claims 1 or 2, wherein said transformer has a magnetizing inductance, appearing across the primary winding thereof, of magnitude selected to cause the inductive resistance thereof to be at least an order of magnitude greater than the maximum resistance to be provided between said input terminals at the lowest frequency of said periodic waveform.

5. The apparatus of claims 1 or 2, wherein said load circuit has additional input terminals for controlling an on/off function of said load circuit, independent of the output level set by the impedance between said input terminals; and further comprising switch means connected to said additional input terminals for controllably establishing the on/off condition of said load circuit.

6. The apparatus of claim 5, wherein said variable impedance means include a mechanical element for adjusting the impedance magnitude thereof, and said switch means is mechanically coupled to said variable impedance adjustment element.

7. The apparatus of claim 6, wherein said switch means is located at a location remote from the location of said load; and further including means for connecting said switch means to said additional input terminals.

8. The apparatus of claim 7, wherein said medium means is one of a twisted wire pair and a coaxial cable.

9. The apparatus of claims 1 or 2, wherein a load includes a lamp having an illumination output, and said load circuit comprises a ballast having said input terminals and adapted to be operatively connected to a lamp for providing an energizing waveform thereto to produce lamp light output of magnitude responsive to the magnitude of the variable impedance element connected to said input terminals.

10. The apparatus of claim 9, wherein the lamp is a gas-discharge lamp.

11. The apparatus of claims 1 or 2, wherein said isolating means is located adjacent to said load.

12. The apparatus of claim 11, wherein said variable impedance element is located at a location remote from the location of said isolating means, and further including medium means for connecting said variable impedance element isolating means.

13. The apparatus of claim 12, wherein said medium means is one of a twisted wire pair and a coaxial cable.

* * * * *